US007812853B2

(12) United States Patent
Altenbach

(10) Patent No.: US 7,812,853 B2
(45) Date of Patent: Oct. 12, 2010

(54) DEVICE FOR SETTING UP, ADJUSTING AND/OR CONTROLLING AN APPARATUS FOR PROCESSING PRINTED PRODUCTS

(75) Inventor: Dieter Altenbach, Vordemwald (CH)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 12/010,854

(22) Filed: Jan. 30, 2008

(65) Prior Publication Data

US 2008/0180513 A1 Jul. 31, 2008

(30) Foreign Application Priority Data

Jan. 30, 2007 (EP) ..... 07405025

(51) Int. Cl.
*B41J 2/435* (2006.01)

(52) U.S. Cl. ..... 347/236; 347/246

(58) Field of Classification Search ..... 382/1.9, 382/112; 347/236, 237, 246, 247
See application file for complete search history.

(56) References Cited

U.S. PATENT DOCUMENTS 2,524,926 A 10/1950 Peery
3,761,177 A * 9/1973 Corse ..... 356/23
7,185,221 B1 * 2/2007 Kamel ..... 714/4
7,187,472 B2 * 3/2007 Friedman et al. ..... 358/1.9
2004/0213436 A1 * 10/2004 Noffke et al. ..... 382/112

FOREIGN PATENT DOCUMENTS

DE 10 2004 049 604 A1 6/2005
DE 20 2005 019 810 U1 3/2006
EP 0 304 564 A1 3/1989
EP 1 481 598 A 12/2004

OTHER PUBLICATIONS

European Search Report dated Sep. 24, 2007 issued in Priority Application No. 07405025.3.

* cited by examiner

*Primary Examiner*—Hai C Pham
(74) *Attorney, Agent, or Firm*—Venable LLP; Robert Kinberg; Justine A. Gozzi

(57) ABSTRACT

A device is provided for setting up, adjusting, and/or controlling an apparatus that cyclically processes printed products. The device includes a lighting unit having at least one light source directed toward a processing area of the apparatus. The light source is controllable to selectively generate a continuous light or a flashing light synchronized with a processing cycle of the apparatus.

15 Claims, 2 Drawing Sheets

DEVICE FOR SETTING UP, ADJUSTING AND/OR CONTROLLING AN APPARATUS FOR PROCESSING PRINTED PRODUCTS

CROSS-REFERENCE TO RELATED APPLICATION

This application claims the priority of European Patent Application No. 07405025.3, filed on Jan. 30, 2007, the subject matter of which is incorporated herein by reference.

BACKGROUND OF THE INVENTION

The invention relates to a device for setting up, adjusting, or controlling an apparatus for processing printed products, the device consisting of a lighting unit with at least one light source for generating a continuous light, wherein the continuous light source is focused onto a processing area of the apparatus.

Apparatuses of this type have long been known in the graphics industry and are used, for example, for producing newspapers, magazines, pamphlets, and books. These apparatuses can be embodied as a sheet feeder, a stitching machine, or a trimmer and can process the printed sheets or signatures accordingly in a gathering and wire-stitching machine.

The apparatuses must be set up and adjusted precisely before the start of a production run and must furthermore be monitored during the operation and, if applicable, adjusted by resetting one of several parameters of a processing area. A precise set-up and adjustment may be required if the goal is to reach a high output. However, with high-output operations, the mechanical sequences to be adjusted are frequently extremely hard to detect since the respective parts move at a high speed, thus making it correspondingly difficult to achieve a precise adjustment. The use of inside lighting for the equipment is known for facilitating the set-up and adjustment, which makes it possible to illuminate the processing area to be adjusted as well as possible with a continuous light. Also known is the use of mobile high-speed cameras and mobile stroboscopes. However, these auxiliary devices are comparatively expensive and difficult to handle.

SUMMARY OF THE INVENTION

It is therefore an object of the invention to create a device for setting up, adjusting, and/or controlling an apparatus of the aforementioned type, which allows for a faster and more precise adjustment, even at comparatively high production speeds. In addition, the cost for the device should not considerably exceed that of presently used devices.

The above and other objects are accomplished according the invention wherein there is provided, in one embodiment, a combination comprising: an apparatus that cyclically processes printed products; and a device for setting up, adjusting, and/or controlling the apparatus, the device comprising a lighting unit including at least one light source directed toward a processing area of the apparatus, the light source being controllable to selectively generate one of a continuous light or a flashing light synchronized with a processing cycle of the apparatus.

Thus, according to the invention, a lighting unit generates a flash of light in place of a continuous light, wherein the flash of light is controlled to be synchronous with the processing cycle for the apparatus. With the device according to the invention, the lighting unit is used to generate both a continuous light and an essentially synchronous flash of light. A flash of light of this type represents a snapshot of sequences that occur too fast to be perceived by the human eye. Such a light flash can be created in a known manner by a high-speed flasher device, also referred to as stroboscope.

The lighting unit according to the invention thus meets two functions. On the one hand, it can be used to illuminate the processing area with a continuous light while, on the other hand, a light flash can be generated synchronous to the machine cycle during the course of the operation. The process to be adjusted can be made visible with the light flash, even at extremely high operational speeds. As a result of the integration of the stroboscope lighting into the lighting unit that generates the continuous illumination, additional costs for mobile stroboscopes and high-speed cameras can for the most part be avoided. The device according to the invention therefore permits a faster, easier, and more precise adjustment and monitoring of the operational processes, without considerable additional costs. The device according to the invention forms a component of an apparatus, for example a sheet feeder, a stitching machine, or a trimmer. However, the apparatus can also comprise several such stations for the sequential processing of printed sheets, as is the case with a gathering and wire-stitching machine.

According to an embodiment of the invention, the control unit controls the light source for generating the essentially synchronous light flash, wherein this control unit preferably functions as a machine control and simultaneously as a control for the light source. At the same time, the continuous illumination source can also be controlled by the control unit, especially for turning it on and off. The light source may be controlled such that during one cycle, the light flash generates a freeze frame image of the moving process for the eye of the observer. The point in time for the light flash can be adjusted within one processing cycle, so that a light flash can be generated at any optional instant during the processing cycle. It is possible in principle to generate several light flashes during a single cycle, or to generate light flashes only following a desired number of cycles, for example each second, third, or fourth cycle.

The processing area in particular is an area with comparatively fast mechanical operating sequences. For example, a sheet is gripped by a gripper or the sheet impacts with an end stop in this processing area. The gripper and/or the end stop are adjusted during the set-up and adjustment phase. The movements of the gripper and the sheets can be fast enough during the running operation, so that the effects of the adjustment on the processing operation are no longer visible in the continuous illumination. Owing to the freeze frame generated with the strobe, the moving parts appear to be standing still and thus make it possible to check and optimize the adjustments that have been carried out.

According to a different embodiment of the invention, an adjustment device adjusts at least one parameter of the processing area, wherein the parameter can be an angle. The adjustment device includes a crank for manually adjusting the aforementioned parameter, e.g. the angle.

According to another embodiment of the invention, the adjustment device includes a drive that is controlled by the operator or the control unit. The adjustment is motorized in that case, whereby the control unit effects an automatic adjustment.

According to yet another embodiment of the invention, the same light source generates both the continuous illumination and the light flashes, thereby resulting in an especially cost-effective and compact embodiment of the lighting unit.

The light source according to another embodiment of the invention includes at least one light-emitting diode (LED), a so-called high-performance LED, which can optionally be used to generate the continuous light or the light flashes, wherein several light-emitting diodes of this type can also be provided in place of a single light-emitting diode. The light-emitting diode may be loaded with a higher capacity for generating the light flashes than for generating the continuous light. The same light-emitting diode can optionally be used to generate the continuous light or the light flashes. The light source thus ensures the generating of a continuous light, as well as the generating of light flashes with a repetition rate of about 60-120,000 flashes/minute.

To protect the personnel operating the apparatus from excessive eye strain, caused by the generated light flashes, the maximum duration of the flashes can be limited by the control unit if the device is operated during a prolonged period, e.g. several hours. Thus, following the generating of light flashes during an interval of, for example, 60 seconds, the control unit automatically switches the lighting unit back to the state for generating continuous light.

According to one embodiment of the invention, the lighting unit comprises light sources with several different colors, wherein at least one light source is intended for the signaling of errors. The processing area can thus be illuminated with a red light for signaling an error, so that the processing area where the error is located is marked immediately and catches the eye. Several such light sources can also be provided, wherein a specific color can be assigned to each type of error. All errors that can occur, for example in connection with a paper jam in the respective processing area, can then be assigned to the "paper jam" error type. Additional error types to be assigned can be "quality controls," "service and maintenance," "compressed air and vacuum supply," or "control error." The intensity of the error signaling can be controlled in dependence on an error characteristic, for example the error frequency, the severity of the error, or the urgency for correction. For example, the more grave the error or its effects, the brighter the generated colored light while an upcoming, non-urgent maintenance operation can be indicated by a weak colored light.

Another embodiment of the invention provides for an input device to adjust the point in time for the light flash during a machine cycle and/or the repetition frequency of the light flash, thus making it possible to optimally adjust the point in time and/or the repetition frequency for the light flash.

Yet another embodiment of the invention uses at least one camera for capturing the processing area at the instant of the light flash, which allows an optimum automatic adjustment of a process. For example, the position of a printed sheet or signature is recorded with the aid of the camera at the instant of the light flash. The images from the camera can then be analyzed inside the control unit and corresponding signals can be transmitted to the adjustment elements for adjusting the process accordingly, by using the aforementioned adjusting drive.

Another embodiment of the invention provides that the shape of the lighting unit is adapted to the processing area. For example, the shape of the lighting unit can be round or polygonal or any other suitable form, which facilitates an adjustment since the areas to be adjusted are specifically illuminated by the continuous light or the light flashes.

BRIEF DESCRIPTION OF THE DRAWINGS

These and other features and advantages of the invention will be further understood from the following detailed description with reference to the accompanying drawings, which show in.

DETAILED DESCRIPTION

Figure 1:
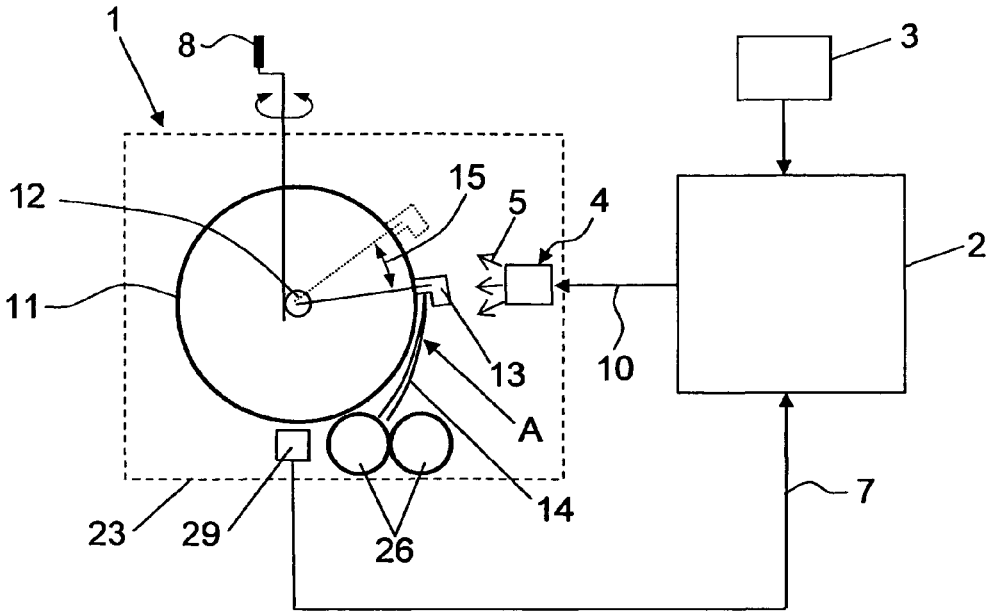
FIG. 1 A schematic of a device according to one embodiment.

Referring to FIG. 1, there is shown an embodiment employing the invention wherein an apparatus 1 in the form of a sheet feeder is provided with a drum 11, in particular a gripping drum, for conveying a sheet 14 that was previously withdrawn from a stack of sheets, not shown herein, to an end stop 13. A sheet feeder of this type is known, for example, from German patent document DE-A-2820876. The sheet 14 is kept ready at end stop 13, in the correct position so that it can be taken over by opening drums 26. The drum 11 is driven in a manner known per se by a drive that is not shown herein. The end stop 13 can be adjusted manually with the aid of a crank 8 in the direction of double arrow 15, wherein this adjustment occurs around a rotational axis 12 of the drum 11 and is thus an angle adjustment. Adjusting the end stop 13 achieves that the sheets 14, which can have different formats, are always aligned so that they can be taken over by the opening drums 26. When setting up a production run and possibly also later on during a re-adjustment, the respective position of the end stop 13 is adjusted precisely through operating the crank 8.

Figure 3:
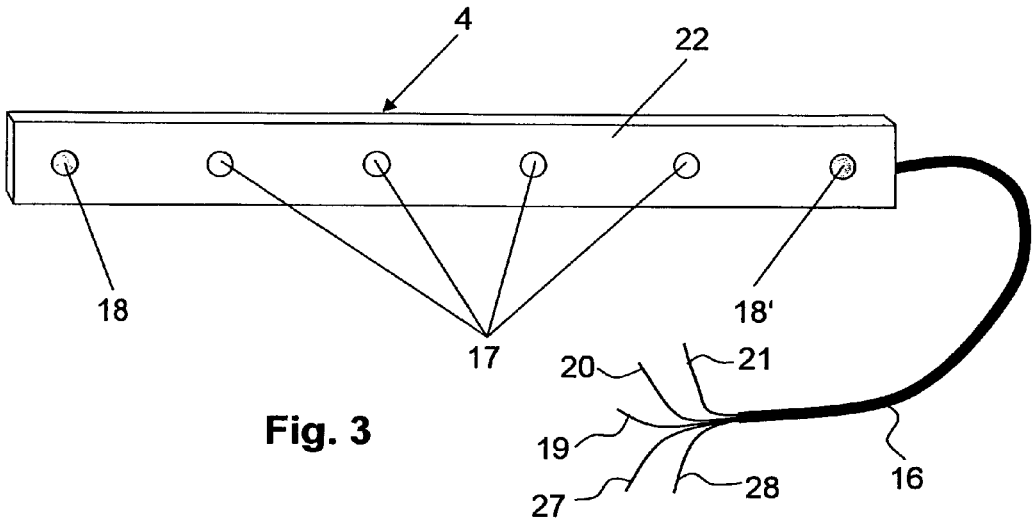
FIG. 3 A schematic three-dimensional view of an embodiment of a lighting unit that may be used to implement the invention.

A lighting unit 4 is provided to make possible the set-up and/or adjustment as well as for monitoring the effects on the processing operation, even at high production speeds. The lighting unit 4 is attached to a housing 23, indicated herein by a dashed line, or any other component of the apparatus 1 so that the light sources are directed toward the processing area A to be adjusted, as shown with the arrows 5 in FIG. 1. According to FIG. 3, the lighting unit 4 consists of a support 22 with thereon arranged light sources 17, for example light-emitting diodes. The light sources 17, as well as additional light sources 18 and 18', which can also be light-emitting diodes, are supplied with electrical energy via a supply line 28 and a ground line 27 of a cable 16. The light sources 17 are triggered via a first control input 19 for generating a continuous light and via a second control input 21 for generating the light flashes. The control input 20 controls the light sources 18.

The light sources 17 may comprise high-capacity light-emitting diodes and can be operated to optionally generate either a continuous light or light flashes. The corresponding control signals are transmitted by the control unit 2. Suitable high-capacity light-emitting diodes and the required electronic components are known to one skilled in the art and do not need to be explained further herein. In principle, other pulse-triggered light sources can also be used in place of high-capacity light-emitting diodes.

The point in time for the light flash is controlled by the control unit 2 and is synchronized with the processing cycle. For this, the control unit 2 is connected via a signal line 7 to a position indicator 29 of the drum 11 and via a signal line 10 to the lighting unit 4. The position of the drum 11 is transmitted continuously to the control unit 2 via the signal line 7 and corresponding signals. The lighting unit 4 is advantageously adjusted to product a light flash at a predetermined moment during each cycle, for example at the moment when the printed sheet 14 hits the end stop 13, as shown in FIG. 1. The sequence of the synchronously controlled light flashes can be adjusted to be staggered in time during one operating cycle and such that the position of the moving sheet during the process can be made visible with a light flash, as if it were standing still. An input device 3 that is connected to the control unit 2 is used for the superimposition. The point in time for the light flash can be adjusted via the input device 3, for example by using suitable keys, several light flashes can be generated during a single processing cycle. It is furthermore provided that the light flashes can be generated only during each second, third, or fourth cycle. With the aid of the light flashes, the user can observe a specific instant during the process, for example the instant when the sheet 14 is at the end stop 13 as shown in FIG. 1. If necessary, adjustments can be made with the aid of the manually operated crank 8.

The light sources 17 can also generate a continuous light, as previously mentioned, which is also directed toward the processing area A to be adjusted. This continuous light is advantageously also controlled by the control unit 2. When setting up the apparatus 1, the control unit 2 initially switches the lighting unit 4 to generate continuous light. Following a first rough adjustment, a light flash that is synchronized with the processing cycle is then generated with the lighting unit 4 in order to check the adjustments. Following the adjustment completion, the control 2 automatically or manually switches the lighting unit 4 to the state for generating a continuous light.

The lighting unit 4 is furthermore provided with additional light sources 18 and 18' for respectively generating one colored light, for example for signaling an error. These light sources 18 and 18' consequently replace a known error indicator light. The colors for the light sources 18 and 18' can differ, so that the respective colors can be assigned to specific error messages. The intensity of the light generated for signaling the error can be controlled in dependence on a characteristic of the error, for example the frequency of the error, the severity of the error, or the urgency for correcting the error, wherein these light sources can again be light-emitting diodes. The control unit 2 can furthermore also activate these light sources 18 and 18'.

Figure 2:
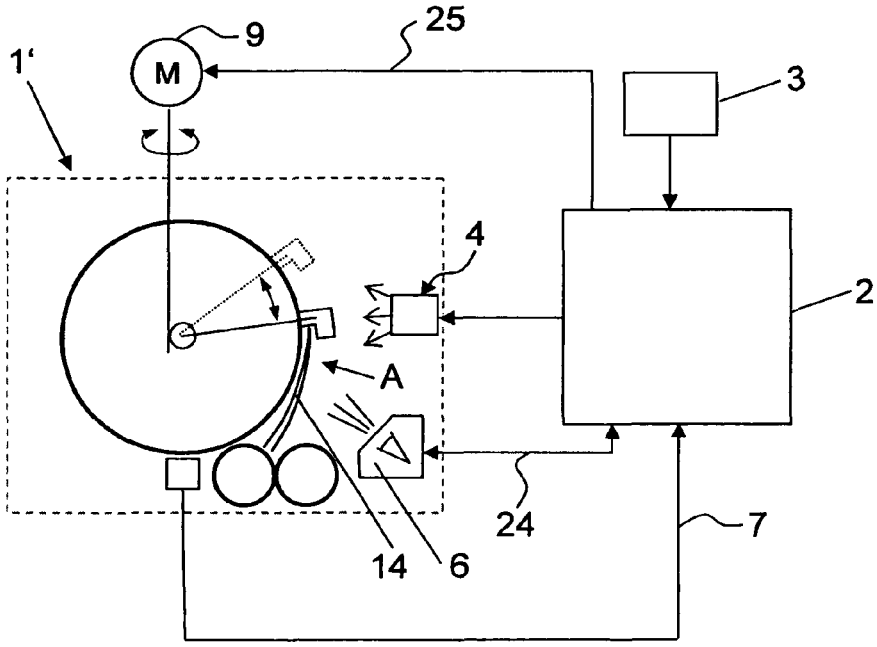
FIG. 2 A schematic of a device according to another embodiment invention.

FIG. 2 shows an apparatus 1' that is additionally provided with a camera 6, in particular a digital high-speed camera, which is also directed toward the processing area A to be adjusted. The camera 6 is connected via a signal line 24 to the control unit. The camera 6 is synchronized with the lighting unit 4, so that the position of the printed sheet 14 can be detected with the camera 6 at the point in time for the freeze frame. The image recorded by the camera 6 is then fed via the signal line 24 to the control unit 2 where the image is analyzed. As a result of the image analysis, the control unit then supplies a signal via an additional signal line 25 to the adjustment drive 9. The signal automatically triggers the adjustment operation that is carried out by the adjustment drive 9. For the embodiment shown herein, the position and in particular the angle position of the end stop 13 is adjusted so that the printed sheet 14 is aligned at the end stop 13 so that the opening drums 26 can take over the sheet 14. The lighting unit 4 can essentially be embodied in the same way as the one for the apparatus 1 according to FIG. 1, wherein a manual adjustment at the input device 3 is also possible.

The aforementioned adjustment of the end stop 13 for aligning a printed sheet 14 represents only one example for changing a parameter of a processing area A. Other adjustment options include, for example, the adjustment of the position and the movements of suction elements and grippers, the depositing of a printed sheet on a gathering chain, the transfer of printed sheets from a first gathering chain to a second chain, the stitching position during the stitching of gathered printed sheets or signatures with the aid of a stitching machine, the feeding of printed sheets into a trimmer, as well as the precise alignment of the printed sheets prior to a trimming operation, the insertion of supplements in an inserting machine, or the gluing of goods samples to a printed product.

The apparatus 1 accordingly can be, for example, a feeder, a gathering chain, a stitching machine, a trimmer, or a cross-stacker. An apparatus comprising several such units, e.g. a gathering and wire-stitching machine, can accordingly also have several processing areas A to be adjusted, as well as several lighting units 4. The latter are mounted immovably or adjustably inside respective machine casings, preferably in the form of inside lights. In this way, a continuous light and/or different light flashes can always be generated with a predetermined orientation for the adjusting and/or re-adjusting.

The shape of the lighting unit 4 for generating the continuous light and the light flash corresponds to the processing area to be adjusted. The shape of the lighting unit 4 is selected such that the light propagation is particularly suitable for the adjustment, for example the cross section may be round, triangular, square, or oval.

It will be understood that the above description of the present invention is susceptible to various modified embodiments, changes and adaptations, and the same are intended to be comprehended within the meaning and range of equivalents of the appended claims.

What is claimed is:

1. A combination comprising:

an apparatus that cyclically processes printed products; and a device for setting up, adjusting, and/or controlling the apparatus, the device comprising:

a lighting unit including at least one light source directed toward a processing area of the apparatus and at least one error signaling light source to signal an error in an operation of the apparatus, the light source being controllable to selectively generate one of a continuous light or a flashing light synchronized with a processing cycle of the apparatus, wherein the error signaling light source has an intensity that is regulated as a function of an error characteristic.

2. The combination according to claim 1, wherein the synchronized flashing light is controlled to produce a chronological sequence of the light flashes within one operating cycle.

3. The combination according to claim 1, further comprising a control unit coupled to the lighting unit to control the at least one light source.

4. The combination according to claim 3, further comprising an input device connected to the control unit to adjust a point in time for occurrence of the light flash.

5. The combination according to claim 1, further comprising an adjustment device arranged to change a parameter of the processing area.

6. The combination according to claim 5, wherein the adjustment device is manually operable.

7. The combination according to claim 1, wherein the light source comprises a light-emitting diode.

8. The combination according to claim 1, wherein the light source comprises a high-capacity light-emitting diode.

9. The combination according to claim 1, wherein the error signaling light source comprises a colored light source.

10. The combination according to claim 1, further comprising a camera arranged to optically capture the processing area at a point in time coinciding with the light flash.

11. The combination according to claim 10, wherein the camera has an output coupled to the control unit and the control unit changes a parameter of the processing area based on the output of the camera.

12. The combination according to claim 11, further comprising an adjustment device arranged to change a parameter of the processing area.

13. The combination according to claim 12, wherein the adjustment device includes an adjustment drive and the control unit is coupled to activate the adjustment drive.

14. The combination according to claim 1, wherein the shape of the lighting unit is adapted to the processing area.

15. The combination according to claim 14, wherein the lighting unit has one of a round, oval, or polygonal shape.

* * * * *